US005279261A

United States Patent [19]

Moscone

[11] Patent Number: 5,279,261

[45] Date of Patent: Jan. 18, 1994

[54] DOWNFIRED BOILER HAVING VERTICAL HEAT TRANSFER TUBES

[76] Inventor: Robert T. Moscone, 55 Waldo St., Millinocket, Me. 04462

[21] Appl. No.: 962,289

[22] Filed: Oct. 16, 1992

[51] Int. Cl.[5] ..... F22B 5/00

[52] U.S. Cl. ..... 122/17; 110/315; 122/135.3

[58] Field of Search ..... 122/14-19, 135.3, 155.5, 160, 110/315, 316

[56] References Cited

U.S. PATENT DOCUMENTS

| | | | |
|---|---|---|---|
| 1,933,056 | 10/1933 | Hamilton | 122/17 |
| 4,380,215 | 4/1983 | Mendelson | 122/17 X |
| 4,401,058 | 8/1983 | Charrier | 122/17 |
| 4,441,436 | 4/1984 | Hayashi | 110/315 |
| 5,027,749 | 7/1991 | Cifaldi | 122/14 X |

FOREIGN PATENT DOCUMENTS

| | | | |
|---|---|---|---|
| 3639194 | 5/1988 | Fed. Rep. of Germany | 122/15 |

*Primary Examiner*—William E. Tapolcai
*Attorney, Agent, or Firm*—Frederick R. Cantor

[57] ABSTRACT

A water-heating boiler of the tube-shell type is designed, so that the heat transfer tubes are vertically oriented. During movement of the hot combustion gases, from the large combustion tube into the smaller heat transfer tubes, the directional change in the gas, is augmented, by a changing effect of gravitational forces on the combustion gas stream. Inertia effects, in combination with velocity changes, produce a relatively high turbulence in the flowing combustion gas, with a corresponding increase in the scrubbing effect on the heat transfer tube walls.

3 Claims, 2 Drawing Sheets

DOWNFIRED BOILER HAVING VERTICAL HEAT TRANSFER TUBES

BACKGROUND OF THE PRESENT INVENTION

The present invention relates to water-heating boilers.

The present invention, more particularly, relates to water-heating boilers of the tube-shell shape.

Conventional water-heating boilers of the tube-shell type, commonly include a relatively large diameter combustion tube, and a series of smaller heat transfer tubes, extending between two parallel upright tube sheets. In these conventional embodiments, the various tubes are horizontally arranged, so that the hot combustion gases flow horizontally through the various heat transfer tubes. Typically, a cylindrical shell encircles the tubes to form a water chamber. Heat contained in the hot gases, is conducted through the heat transfer tube walls into the surrounding water.

SUMMARY OF THE PRESENT INVENTION

An object of the present invention is to provide an improved water-heating boiler.

A further object of the present invention, is to provide a water-heating boiler of the tube-shell shape.

It has been found, that by redesigning the tube-shell water-heating boiler, so that the heat transfer tubes are oriented vertically, instead of horizontally, the heat transfer efficiency is measurably improved. Typically, an efficiency increase of about ten (10) percent is achieved.

In constructing the boiler, the preferred material to use is stainless steel, containing nickel, as the material for the combustion tube, the heat transfer tubes, and for the wall of the gas reversal chamber, located below the heat transfer tubes, although other suitable metals may also be used. It is believed that the nickel in the stainless steel, acts as a catalyst, in order to promote complete combustion of the fuel.

Presumably, various burners could be used to generate the hot combustion gases in the main combustion tube. However, it has been found that an oil burner marketed by HEAT WISE, INC., [Post Office Box 662, Ridge, N.Y.], under its model designation BK-1, provided optimum performance. Using such a burner, we have achieved heat transfer efficiencies of about eighty-eight (88) percent. With the burner consuming oil at a rate of 1.20 gallons per hour, at a pressure of 200 pounds per square inch, the combustion gases had a temperature in the range of from about 2,500 to about 2,600 degrees FAHRENHEIT. The combustion gases had a carbon dioxide ($CO_2$) content of about sixteen (16) percent, with no smoke.

It has been determined that effective heat transfer is promoted by generating turbulence in the combustion gases. The gaseous turbulence exerts a scrubbing action on the heat transfer tube walls, which disturbs the relatively stagnant film on the heat transfer tube surfaces. When the heat transfer tubes are arranged vertically, as in the boiler of the present invention, the hot combustion gases, undergo a relatively violent directional change, as such gases move from the main combustion tube into the smaller heat transfer tubes.

In the main combustion tube, the hot gases move directly downward, whereas in the smaller heat transfer tubes, the hot gases move directly upward. In one case, gravity acts in the direction of the flow, whereas in the other case, gravity opposes the flow. It is believed that the gravitational forces contribute a turbulence effect to the hot gases, that is not present with conventional horizontal tube-shell arrangements.

In the water-heating boiler of the present invention, the gravitational force on the flowing gas produces localized velocity changes that contribute to increase gaseous turbulence. Gas flow in the main combustion tube is somewhat increased, whereas gas flow in the heat transfer tubes, is somewhat decreased. As the gases reverse direction at the lower ends of the connected tubes, inertia forces are generated that contribute to an increased turbulence in the flowing gases. Such increased turbulence is believed to be largely responsible for the increased heat transfer efficiency of the boiler, of the present invention. The use of stainless steel, as the material for the heat transfer tubes is also believed to be a contributing factor in the improved performance.

In summary, and in accordance with the above discussion, the foregoing objectives are achieved in the following embodiments.

1. A water-heating boiler, comprising upper and lower tube sheets, each of said sheets being oriented in a horizontal plane; a vertically oriented combustion tube, having upper and lower end portions thereof extending through said tube sheets; a burner located above said combustion tube, said burner comprising a vertically oriented burner tube, positioned to discharge flames downwardly into said combustion tube; a plurality of vertically oriented heat transfer tubes, extending between said tube sheets, alongside said combustion tube; a gas reversal chamber communicating the lower end of said combustion tube with the lower ends of said heat transfer tubes, whereby hot combustion gases are caused to travel upwardly through the heat transfer tubes; a manifold connected to said upper tube sheet, in overlying relation to the heat transfer tubes, whereby combustion gases are discharged from said heat transfer tubes, into the manifold; a stack, extending upwardly from said manifold; a tubular shell spanning said upper and lower tube sheets, to define a water chamber surrounding the combustion tube, and the heat transfer tubes; a water inlet, connected to said shell near said lower tube sheet; and a water outlet, connected to said shell near said upper tube sheet.

2. The water-heating boiler, as described in paragraph 1, wherein said gas reversal chamber, is defined partly by said lower tube sheet, and a flat horizontal panel, spaced below said lower tube sheet.

3. The water-heating boiler, as described in paragraph 2, wherein said combustion tube, said heat transfer tubes, and said gas reversal chamber, are formed of stainless steel.

4. The water-heating boiler, as described in paragraph 2, wherein said tubular shell, extends downwardly, beyond said lower tube sheet, to connect with said flat horizontal panel, and thus form a peripheral wall of said gas reversal chamber.

5. The water-heating boiler, as described in paragraph 3, and further comprising, an insulator pad, positioned flatwise against said flat horizontal panel, to minimize heat flow through said flat horizontal panel.

6. The water-heating boiler, as described in paragraph 1, wherein said tube sheets are rectangular in plan configuration; and said tubular shell, further comprising, flat vertical walls, welded to the edges of said tube sheets.

7. The water-heating boiler, as described in paragraph 6, wherein said tubular shell, is further comprised of two U-shaped sections, formed of sheet steel.

8. The water-heating boiler, as described in paragraph 1, wherein said combustion tube, further comprises, a circular tube extending downwardly beyond the lower tube sheet, into said gas reversal chamber; and said combustion tube, having a lower end, acutely angled to a horizontal plane, such that the edge area, in nearest proximity to said heat transfer tubes, is elevated above said edge area, remote from said heat transfer tubes.

9. The water-heating boiler, as described in paragraph 8, wherein said gas reversal chamber, is defined, partly by said lower tube sheet and a flat horizontal panel, spaced below said lower tube sheet; and said acutely angled lower end edge of said combustion tube, being located in near proximity to said flat horizontal panel.

10. The water-heating boiler, as described in paragraph 9, wherein said lower end edge, of said combustion tube, is acutely angled to a horizontal plane, at an angle of approximately fifteen (15) degrees.

DESCRIPTION OF THE PREFERRED EMBODIMENTS OF THE PRESENT INVENTION

Figure 1:
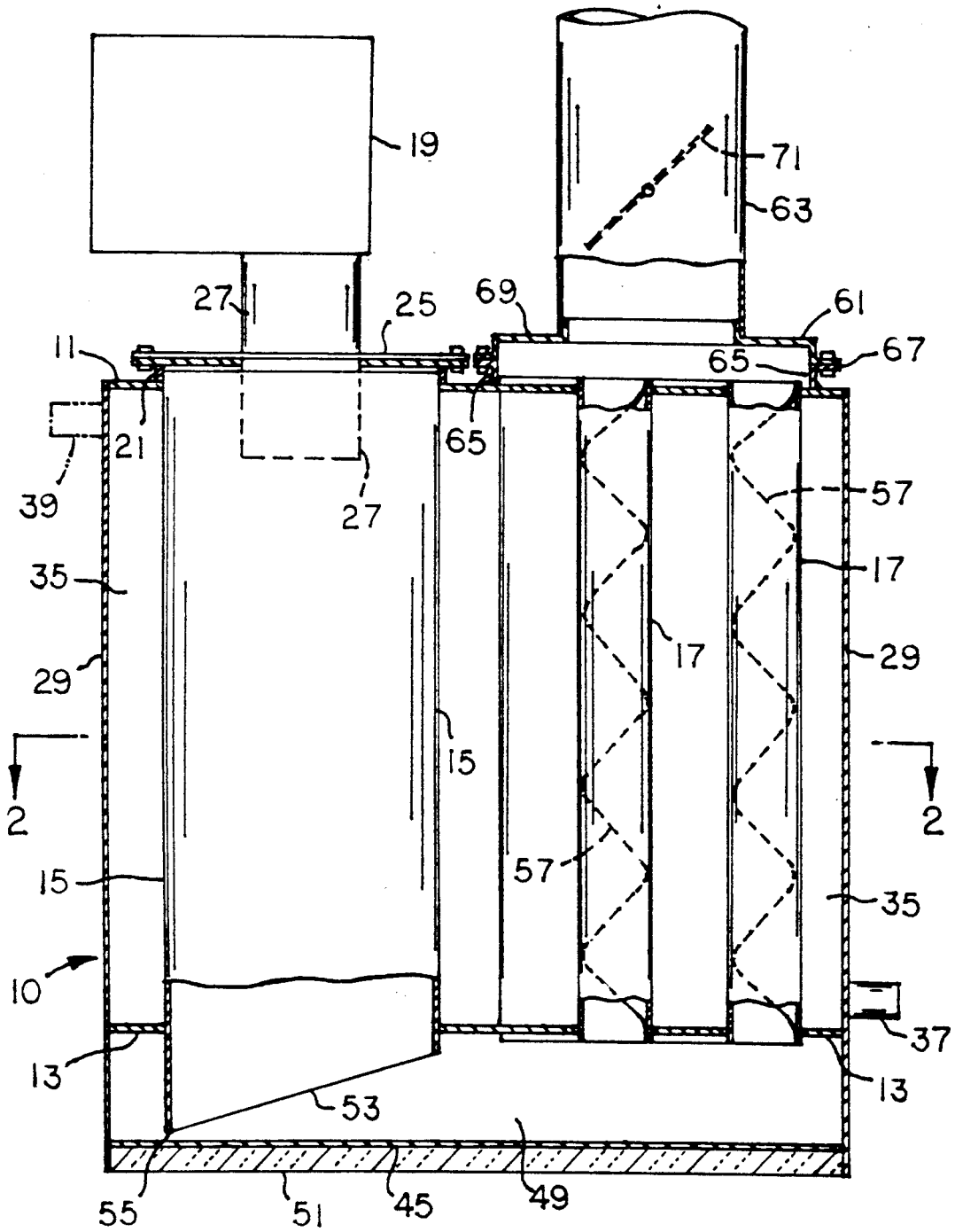
FIG. 1, is a sectional view, taken through a water-heating boiler, constructed according to the present invention.

FIG. 1, is a sectional view, taken through a water-heating boiler, constructed according to the present invention.

Figure 2:
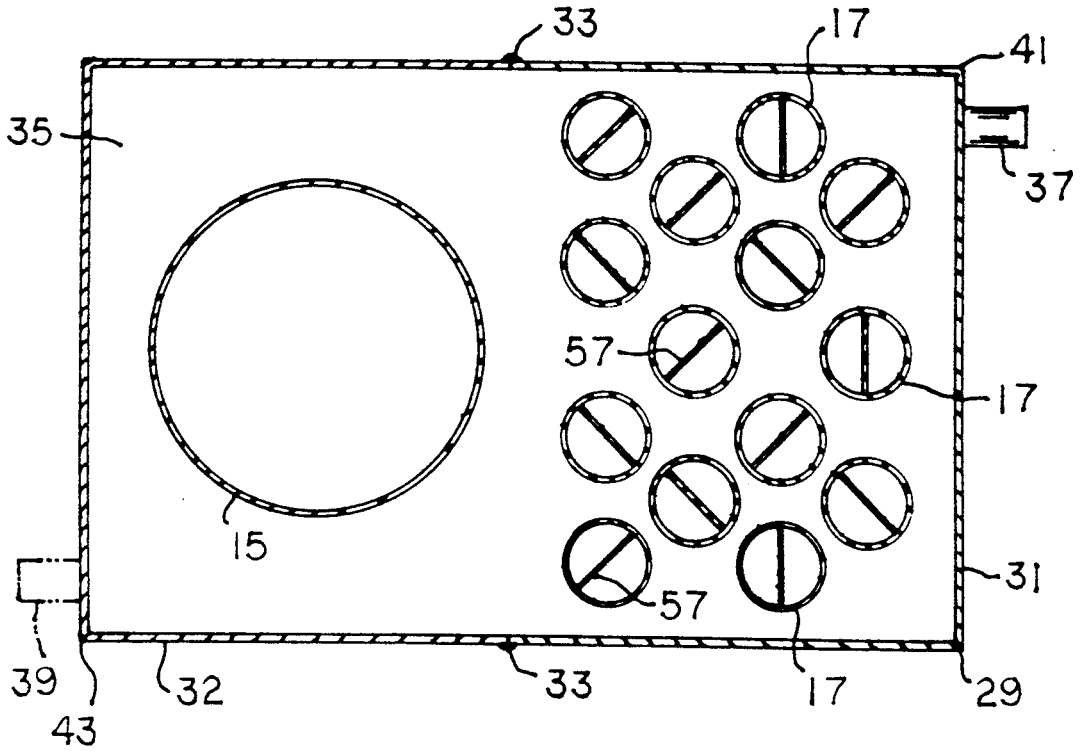
FIG. 2, is a transverse, sectional view, taken along line 2—2, in FIG. 1.

FIG. 2, is a transverse, sectional view, taken along line 2—2, in FIG. 1.

The drawings herein, show a water-heating boiler 10, that includes an upper horizontal tube sheet 11, and a lower horizontal tube sheet 13. A vertically oriented combustion tube 15, extends between, and through, the tube sheets 11 and 13. Additionally, a plurality of vertically oriented heat transfer tubes 17, extend through the tube sheets 11 and 13. The number of heat transfer tubes 17, will vary, according to the heat transfer tube 17 diameter, and the diameter of the combustion tube 15. The combined gas flow area of heat transfer tubes 17, is preferably slightly less than the gas flow area of combustion tube 15.

In one specific water-heating boiler construction, combustion tube 15, had a diameter of eight (8) inches, and each heat transfer tube 17, had a diameter of two (2) inches. In this case, there were fourteen (14) heat transfer tubes.

Combustion tube 15, heat transfer tubes 17, and the gas reversal chamber 49, are preferably constructed of austenitic stainless steel, containing chromium and nickel, although other suitable metals may also be used. It is believed that the nickel present in the steel, functions as a catalyst, at elevated temperatures, for promoting complete combustion of the burned fuel. The various tubes, i.e., combustion tube 15, and heat transfer tubes 17, are welded to tube sheets 11 and 13, to prevent leakage of gas into the surrounding space.

As shown in FIG. 1, a fuel burner 19, is located above the main combustion tube 15, so as to discharge flames downwardly into the combustion tube 15. The flames will extend substantially the entire vertical length of combustion tube 15. Typically, combustion tube 15, will have a length of about twenty-one (21) inches. Fuel burner 19, which may be a gas or oil burner, in this invention, is preferably an oil burner, supplied by HEAT WISE, INC. [Post Office Box 662, Ridge, N.Y.], under its model designation, BK-1. The BK-1 burner, develops an oil pressure of approximately two-hundred pounds per square inch, which achieves a flame temperature of about 2,500 degrees FAHRENHEIT in combustion tube 15.

The oil burner 19, may be mounted in various ways. As shown in FIG. 1, the burner mounting means comprises a circular collar 21, extending upwardly from tube sheet 11, and a square plate 23, welded to the circular collar 21. The burner 19, further comprises a flat mounting plate 25, suitably bolted to square plate 23. A cylindrical flame discharge tube 27, extends downwardly from the burner 19 housing, through mounting plate 25, and into combustion tube 15.

The heat exchanger portion of the water-heating boiler comprises a tubular shell 29, extending between tube sheets 11, and 13, to define a water chamber surrounding the combustion tube 15, and the heat transfer tubes 17. The tubular shell 29, can be constructed, or sectioned, in various ways, e.g., as a one-piece tubular element. Preferably, however, for fabrication purposes, the tubular shell 29, is formed out of two U-shaped sections, numbered 31 and 32, in FIG. 2. As shown in FIG. 2, the two U-shaped sections, i.e., 31 and 32, have vertical end edges thereof, welded together to form vertical seams 33. U-shaped section 31, forms the right half of the tubular shell 29, whereas U-shaped section 32, forms the left half of the tubular shell 29. The tubular shell 29, is continuously welded to the tube sheets 11 and 13, so as to provided a sealed water chamber, designated in the drawings by numeral 35.

Water is supplied to water chamber 35, through an inlet pipe 37, located near tube sheet 13. Water is discharged out of water chamber 35, through an outlet pipe 39, located near tube sheet 11. The inlet pipe 37, and outlet pipe 39, are, preferably, located diagonally apart at different corners of the rectangular tubular shell 29. Thus, as shown in FIG. 2, inlet pipe 37, is located near vertical corner 41, of the tubular shell 29, whereas outlet pipe 39, is located near the diagonally opposite vertical corner 43, of the tubular shell 29. Outlet pipe 39, is shown in dashed lines, in the drawing, since it would not be visible when viewed in the directions taken by the drawings.

A water pump, not shown, will be used to pump the water through water chamber 35, for use in a domestic hot water system, e.g., in a baseboard room heating system, or a hot water supply system.

It will be seen from FIG. 1, that tubular shell 29, extends downwardly beyond the lower tube sheet 13, to connect with a lower flat panel 45. Flat panel 45, has the same dimensions as tube sheet 13, so as to form the bottom wall of a rectangular chamber, designated by numeral 49. Chamber 49, is, hereinafter, referred to as the gas reversal chamber 49, in that it causes the downflowing gases in combustion tube 15, to reverse direction, as the gases prepare to move into heat transfer tubes 17. The hot combustion gases flow downwardly in combustion tube 15, and upwardly in heat transfer tubes 17.

Flat panel 45, is, preferably, formed of the same stainless steel material, that is also used for combustion tube 15, and heat transfer tubes 17. The flat panel 45, is continuously welded to tubular shell 29, in order to seal gas reversal chamber 49. Since flat panel 45, becomes relatively hot during operation of the water-heating boiler, an insulator pad 51, is secured, flat-wise, to the lower edge surface of flat panel 45. The insulator pad 51, may be formed of a ceramic insulator material, resistant to elevated temperatures. Flat panel 45, can reach a temperature of about 2,500 degrees FAHRENHEIT.

The gas reversal chamber 49, preferably, has a relatively small vertical thickness, e.g., about three inches. There is a danger that the downflowing combustion gas in combustion tube 15, could forcibly strike flat panel 45, and rebound directly upwardly back into combustion tube 15, thereby impeding the throughput of gas out of the water-heating boiler. To minimize such an undesired rebound action, combustion tube 15, is constructed, so that its lower end edge 53, is acutely angled to a horizontal plane, normal to the axis of the combustion tube 15. In a preferred arrangement, the angulation of end edge 53, is about fifteen (15) degrees.

The angulation of end edge 53, is such that the edge area in nearest proximity to heat transfer tubes 17, is elevated above the edge area 55, most remote from the heat transfer tubes 17. As the combustion gases flow downwardly out of combustion tube 15, they tend to expand, or diverge, in a rightward direction, rather than rebounding back into combustion tube 15. Edge area 55, is located near, but not in direct contact with, flat panel 45, so that some gas can flow around edge area 55, and into the gas reversal chamber 49. Angled combustion tube 15, edge 53, serves as a gas flow-turning mechanism, whereby the gas is turned from a downflow condition, towards a horizontal flow condition, as it emerges from combustion tube 15.

In order to improve the gas turbulence in heat transfer tubes 17, each heat transfer tube 17, is preferably equipped with a spirally configured turbulator strip 57, of the shown construction. The turbulator strip 57, subdivides the heat transfer tube 17 space, into two spirally moving gas streams. The turbulator strips 57, enhance the turbulence that is generated in the gas, due to its change of direction in the gas reversal chamber 49.

While the gas is moving downwardly in combustion tube 15, it is slightly accelerated by gravitational forces. As the gas begins to move upwardly, in heat transfer tubes 17, it acts against the gravitational forces. Additionally, there is an inertia effect due to the change in direction, such that considerable gas turbulence is generated by the opposing forces.

In a preferred embodiment the gas flow area of combustion tube 15, is slightly greater that the total gas flow area of heat transfer tubes 17. For example, the gas flow area of combustion tube 15, may be about fifty (50) square inches, whereas the total flow area of heat transfer tubes 17, may only be about forty-five (45) square inches. The area relationships are such, that there is both a velocity change, and a pressure change, in the gas, as it moves into heat transfer tubes 17, in addition to the directional change and gravitational force changes. The velocity change, will thus contribute to an increased gas turbulence, and result in an enhanced scrubbing effect on the heat transfer tube walls 17.

The gas emerges from the upper ends of heat transfer tubes 17, into a manifold 61, that is connected to cylindrical stack 63. As shown in FIG. 1, the manifold 61, comprises an upstanding annular wall 65, having a flange 67. A rectangular cover 69, has a peripheral flange that bolts onto flange 67, to provide a sealed manifold space. The plan dimension of the manifold 61 space, is large enough to encompass the array of heat transfer tube 17 ends, whereby the combustion gas streams are combined for passage upwardly into stack 63. The stack 63, may be equipped with either a manual preset, or a motor-operated damper 71, for controlling the draft within combustion tube 15, and heat transfer tubes 17, either positive or negative. An optional induced draft fan, not shown, may be connected to stack 63, to provide a further control on the draft conditions.

The present invention relates to water-heating boilers, having vertical heat transfer tubes. Features of the present invention are recited in the appended claims. The drawings contained herein necessarily depict certain structural features and embodiments of the apparatus, useful in the practice of the present invention.

However, it will be appreciated by those skilled in the arts pertaining thereto, that the present invention can be practiced in various alternate forms and configurations. Further, the previous detailed descriptions of the preferred embodiments of the present invention, are presented for purposes of clarity of understanding only, and no unnecessary limitations should be understood or implied therefrom. Finally, all appropriate mechanical and functional equivalents to the above, which may be obvious to those skilled in the arts pertaining thereto, are considered to be encompassed within the claims of the present invention.

What is claimed is:

1. A water heating boiler comprising:

upper and lower tube sheets, each of said tube sheets, being oriented in a horizontal plane;

a vertically oriented circular combustion tube having upper and lower end portions thereof extending through said tube sheets;

a burner located above said combustion tube;

said burner comprising a vertically oriented burner tube positioned to discharge flames downwardly into said combustion tube;

a plurality of vertically oriented heat transfer tubes extending between said tube sheets alongside said combustion tube;

a gas reversal chamber communicating the lower end of said combustion tube with the lower ends of said heat transfer tubes, whereby hot combustion gases are caused to travel upwardly through said heat transfer tubes;

a manifold connected to said upper tube sheet, in overlying relation to said heat transfer tubes, whereby said combustion gases are discharged from said heat transfer tubes into said manifold;

a stack extending from said manifold;

a tubular shell spanning said upper and lower tube sheets to define a water chamber surrounding said combustion tube and said heat transfer tubes;

a water inlet connected to said tubular shell near said lower tube sheet;

a water outlet connected to said tubular shell near said upper tube sheet;

said circular combustion tube having a lower end edge located within said gas reversal chamber; and said lower end edge of said combustion tube being acutely angled to a horizontal plane, with the end edge area in nearest proximity to said heat transfer tubes being elevated above the end edge area remote from said heat transfer tubes.

2. The water heating boiler, as described in claim 1, wherein said gas reversal chamber is defined partly by said lower tube sheet, and a flat horizontal panel spaced below said lower tube sheet; and said lower end edge of said combustion tube being located in near proximity to said flat horizontal panel.

3. The water heating boiler, as described in claim 1, wherein said lower end edge of said combustion tube is acutely angled to a horizontal plane at an angle of approximately fifteen (15) degrees.

* * * * *